US005504377A

United States Patent [19]

Nowell

[11] Patent Number: 5,504,377

[45] Date of Patent: Apr. 2, 1996

[54] AUTOMOBILE ELECTRIC DOOR LOCK SAFETY SYSTEM AND METHOD FOR PREVENTING THE INADVERTENT LOCKING OF KEYS IN AN AUTOMOBILE

[76] Inventor: Derrell D. Nowell, 822 W. 6th, Muleshoe, Tex. 79347

[21] Appl. No.: 191,007

[22] Filed: Feb. 3, 1994

[51] Int. Cl.[6] ..... E05B 65/20

[52] U.S. Cl. ..... 307/10.1; 70/237; 180/289; 340/457

[58] Field of Search ..... 307/9.1–10.6; 361/170; 70/237, 252, 255, 258, 263, 262, 277, 441, DIG. 59; 180/271, 287, 289; 340/425.5, 426, 428, 457, 825.31, 825.32

[56] References Cited

U.S. PATENT DOCUMENTS

| | | | |
|---|---|---|---|
| 3,399,554 | 9/1968 | Hogue | 70/262 |
| 3,646,511 | 2/1972 | Holt | 340/457 |
| 3,649,960 | 3/1972 | Severn | 340/457 |
| 4,137,985 | 2/1979 | Winchell | 70/237 |
| 4,428,024 | 1/1984 | Mochida et al. | 340/829.31 |
| 4,572,320 | 2/1986 | Robbins, Jr. | 180/289 |
| 4,709,777 | 12/1987 | Metz | 180/289 |
| 4,730,120 | 3/1988 | Okada | 70/263 |
| 4,789,851 | 12/1988 | Hock et al. | 340/457 |
| 4,942,747 | 7/1990 | Pinnow | 70/263 |
| 5,113,174 | 5/1992 | Wake | 340/457 |

*Primary Examiner*—William M. Shoop, Jr.
*Assistant Examiner*—Richard T. Elms
*Attorney, Agent, or Firm*—Novak Druce Herrmann Burt

[57] ABSTRACT

A system to disable the electric door lock mechanism of an automobile when the key is in the ignition and the driver's side door is open comprising a normal closed switch spliced into the electric door mechanism wires and the door chime system wires. The system prevents a driver from inadvertently locking their keys in an automobile and can be easily installed in most vehicle with electric door locks.

4 Claims, 1 Drawing Sheet

PRIOR ART

AUTOMOBILE ELECTRIC DOOR LOCK SAFETY SYSTEM AND METHOD FOR PREVENTING THE INADVERTENT LOCKING OF KEYS IN AN AUTOMOBILE

BACKGROUND OF THE INVENTION

1) Field of the Invention

The present invention relates to automobile door lock safety switches, and more particularly to a automobile door lock safety switch for disabling electric door locks when the ignition key has not been removed from the ignition and the driver side door is in the open position.

2) Background Art

Almost every automobile driver has had the misfortune of accidentally locking their keys in their automobile. While this usually leads to aggravation or embarrassment for the driver. The driver may also have to pay for the expense of a locksmith if an additional set of keys are not available.

The situation is exacerbated by the increase in automobile theft and the ability of the thieves to easily and quickly break-in to an automobile. And with the keys left in the ignition, all a thief has to do is break the window and the operator's car has become another statistic of grand theft auto. Then the operator has to worry about the insurance company failing to reimburse them because of their error of leaving the keys in the automobile, which led to the theft.

Some systems have attempted to alleviate this problem by providing an audible warning to the automobile operator that their keys were still engaged in the ignition switch. However, a hurried operator may lock and close the door before responding to the warning. Other systems directed at preventing even a hurried driver from locking their keys in the automobile are integrated into the electrical system and involve complex installation and a premium cost. These systems might be appropriate for higher income drivers, but the middle and lower income driver is without a solution to the very common problem of locking their keys in their automobile.

SUMMARY OF THE INVENTION

The present invention protects the operator of an automobile from inadvertently locking the door to their automobile when their keys are in the ignition of the automobile. The present invention is utilized in conjunction with automobiles having electric or electro-mechanical locking systems and consists essentially of a twelve volt normal closed switch wired through the automobile's door chime system or open door lighting system, and the electric or electro-mechanical door lock mechanism. When the key is in the ignition, and the operator's door is opened, the locking system is rendered inoperative until the key is removed from the ignition. In this way, a driver is prevented from accidentally locking their keys in the automobile.

It is an object of the present invention to provide a means for preventing the operator of an automobile from inadvertently locking their keys in their automobile.

It is a further object of the present invention to provide a simple addition to existing automobiles to prevent an operator from locking their keys in the automobile.

It is a further object of the present invention to provide a switch that can be easily installed on an automobile to prevent the operator from locking their keys in the automobile.

Other objects will be apparent from the detailed description of the invention.

DETAILED DESCRIPTION OF THE INVENTION.

Figure 1:
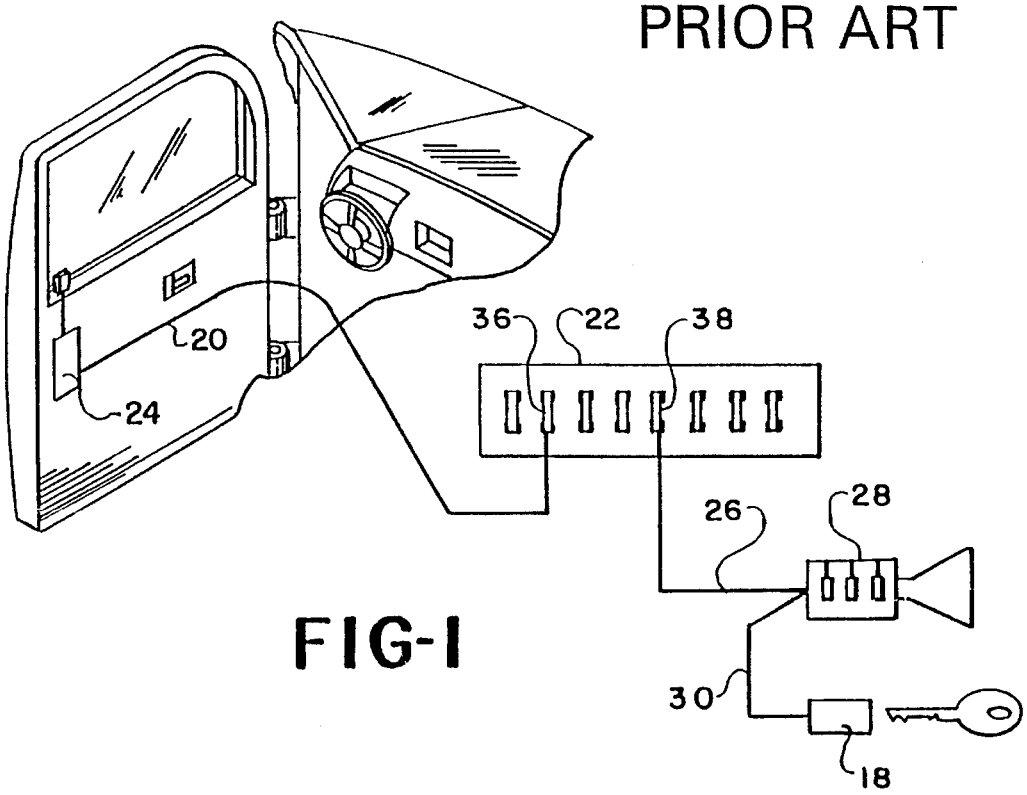
FIG. 1 is a block diagram of an automobile's electric door system.

FIG. 1 is a block diagram of an automobile's electric door system. FIG. 1 illustrates the components of an automobile's electric door system that will become part of the present invention. The electric door lock live wire 20 is connected between the electric door lock fuse 36 of the fuse box 22, and the electric door lock mechanism 24, which is either an electric or electro-mechanical system. The electric door lock wire 20 will have to be severed into two separate wires. However, a current always flows through the electric door lock wire 20, even when the ignition of the automobile is not activated. In order to prevent the flow of current, the battery 10 must be disconnected from the automobile's electric system. This is accomplished by removing the positive and negative connector wires from the battery 10 itself. Once the automobile's electric system is disengaged from its source of electrical current, the battery 10, an installer can safely sever the electric door lock wire 20.

The door chime wire 26 is a live wire for the electric door chime system 28. The wire 26 is connected between the electric door chime system fuse 38 of the fuse box 22, and the door chime system 28. The ignition ground wire 30 is connected between the door chime system 28 and the ignition 18. The door chime system 28 is activated when a key is left in the ignition 18 and the driver's side door is open. The door chime is an audible warning that alerts the automobile operator, and provides a means for indicating when the keys are engaged in the ignition lock and the driver's side door is open. This would usually suffice to alert a driver of the forthcoming possibility of locking their keys in the automobile. However, an inattentive driver, or a driver in a hurry, may disregard or fail to acknowledge the audible warning and lock their keys in the automobile. The present invention would prevent this misfortune from occurring by disabling the electric door lock mechanism when the keys are in the ignition.

Figure 2:
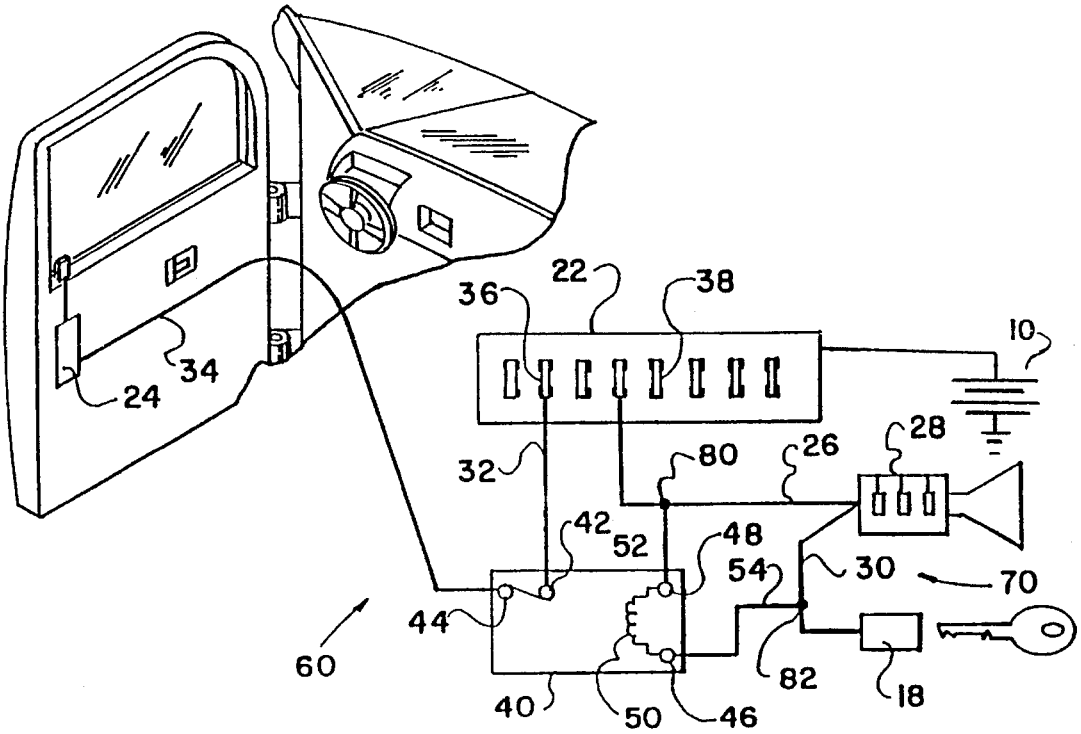
FIG. 2 is a block diagram of the present invention.

FIG. 2 is a block diagram of the preferred embodiment of the present invention. The twelve volt normal closed switch 40 is a standard electrical switch that may be purchased at most retail electric part stores. Other normal closed switches of varying voltages may be utilized, however, a twelve volt normal closed switch is the preferred switch. The switch 40 consists of a twelve volt coil 50 and terminals 42, 44, 46 and 48.

The electric door lock wire 20 of FIG. 1 is severed, and it becomes a first wire 32 and a second wire 34 as shown in FIG. 2, each wire 32 and 34 having a severed end with an exposed portion of copper wire. First wire 32 is connected between the electric door lock fuse 36 of the fuse box 22 and a first terminal 42 of the switch 40, with severed end of first wire 32 being attached to first terminal 42 by winding the exposed portion of first wire 32 around first terminal 42.

Second wire 34 is connected between the electric door lock mechanism 24 and a second terminal 44 of the switch 40, with the severed end of second wire 34 being attached to second terminal 44 by winding the exposed portion of second wire 34 around second terminal 44. Connecting first wire 32 to first terminal 42 and second wire 34 to second terminal 44 creates a first closed circuit 60 from the fuse box 22 to the electric door lock mechanism 24, subject to control by the switch 40. The first closed circuit 60 provides a means to override the electric door lock system when a key is in the ignition and the driver's side door is open.

A third wire 52 is connected from the third terminal 48 of the switch 40 into the door chime wire 26 at point 80. A fourth wire 54 is connected from a fourth terminal 46 of the switch 40 into the ignition ground wire 30 at point 82.

Connected between terminals 46 and 48, and inside the switch 40, is the twelve volt coil 50. A second closed circuit 70 is created, flowing from the door chime mechanism 28 through the door chime wire 26 through the third wire 52 to third terminal 48 of the switch 40, through the coil 50, to fourth terminal 46, through fourth wire 54, through the ignition ground wire 30 and to ignition 18. This second closed circuit 70 is grounded, and thus activated, by the keys being engaged in the ignition 18.

When a key is left in the ignition 18 and the operator's side door is open the door chime mechanism 28 is activated. When the door chime mechanism 28 is activated, a current will flow through door chime wire 26, through third wire 52 and through the coil 50. When current flows through the coil 50, the coil is energized and thus causes inductance to build up in coil 50 which then opens normal closed switch 40 which opens the previously closed circuit 60 from the fuse box 22 through the switch 40 and then to the electrical door lock mechanism 24. In this manner, the invention prevents an operator of the automobile from inadvertently locking their keys in the automobile since the electric door lock mechanism 24 is rendered inoperative until the keys are removed from the ignition.

Once the keys are removed from the ignition 18, the ignition ground is broken, which deactivates the door chime mechanism 28. The deactivation of the door chime mechanism 28 removes current from the coil 50, eliminating the inductance and thus removing the choke action from the switch 40, which in turns closes the circuit from the fuse box 22 to the electric door lock mechanism 24. Thus, the electric door lock system is again operable and the driver has avoided locking their keys in their automobile.

The normal closed switch 40 is attached under the dashboard of the automobile near the steering column. The switch 40 can be installed in the factory or installed in the after-market. The ability to install the invention in the after-market provides the less affluent car owner with the ability to have lock-out prevention without the cost of an electrically complex, more expensive system.

The embodiments of the invention in which an exclusive property or privilege is claimed are defined as follows:

1. A method for preventing the inadvertent locking of ignition keys in an automobile, by a driver of the automobile, comprising the steps of:

disconnecting a battery from an automobile so as to disengage the electrical power from said automobile;

severing a first wire, which is connected to a fuse box on one end and an electrical door lock mechanism on the other end, into a first part being connected to said fuse box, and a second part connected to said electrical door lock mechanism, each part having a severed end;

attaching said severed end of said first part of said first wire to a first terminal on a normal closed switch;

attaching said severed end of said second part of said first wire to a second terminal on said normal closed switch, thereby creating a first circuit from said fuse box, through said normal closed switch, to said electrical door lock mechanism;

connecting a second wire from a third terminal on said normal closed switch to a third wire, said third wire connected between an ignition and a door chime system;

connecting a fourth wire from a fourth terminal on said normal closed switch to a fifth wire, said fifth wire connected between said door chime system and said fuse box, thereby creating a second circuit from said door chime system through said normal closed switch and to said ignition;

activating said door chime system when said door is open and a key is engaged in said ignition;

energizing a coil, located between said third terminal and said fourth terminal on said normal closed switch, when said door chime system is activated;

opening said normal closed switch, which opens said first circuit, when said coil is energized;

disengaging said electric door lock mechanism when said first circuit is open; and closing said first circuit when said key is removed from said ignition.

2. The method of preventing the inadvertent locking of keys in an automobile according to claim 1 wherein said normal closed switch is a twelve volt normal closed switch.

3. The method of preventing the inadvertent locking of keys in an automobile according to claim 2 wherein said closing of said first circuit allows said electric door lock mechanism to reactivate.

4. The method of preventing the inadvertent locking of keys in an automobile according to claim 1 wherein the coil further comprises a twelve volt coil.

* * * * *